United States Patent [19]

Nishikawa et al.

[11] Patent Number: 4,985,709

[45] Date of Patent: Jan. 15, 1991

[54] MAGNETOSTATIC WAVE DEVICE

[75] Inventors: Toshio Nishikawa; Hiroaki Tanaka; Satoru Shinmura, all of Nagaokakyo, Japan

[73] Assignee: Murata Manufacturing Co., Ltd., Kyoto, Japan

[21] Appl. No.: 365,073

[22] Filed: Jun. 12, 1989

[30] Foreign Application Priority Data

Jun. 24, 1988 [JP] Japan ..... 63-157826

[51] Int. Cl.[5] ..... H01Q 1/00

[52] U.S. Cl. ..... 343/787; 333/161

[58] Field of Search ..... 343/787, 700 MS File, 343/748; 333/161, 245

[56] References Cited

U.S. PATENT DOCUMENTS

| | | | |
|---|---|---|---|
| 3,016,535 | 1/1962 | Hewitt, Jr. | 343/787 |
| 3,283,330 | 11/1966 | Chatelain | 343/700 MS |
| 4,403,221 | 9/1983 | Lamberg et al. | 343/700 MS |
| 4,507,664 | 3/1985 | James et al. | 343/700 MS |
| 4,554,519 | 11/1985 | Adam | 333/145 |
| 4,675,682 | 6/1987 | Adam et al. | 333/147 |
| 4,679,012 | 7/1987 | Buck | 333/161 |

FOREIGN PATENT DOCUMENTS 55-143818 11/1980 Japan .
55-143819 11/1980 Japan .

*Primary Examiner*—Rolf Hille
*Assistant Examiner*—Hoanganh Le
*Attorney, Agent, or Firm*—Jordan and Hamburg

[57] ABSTRACT

A magnetostatic wave device comprises a ferrimagnetic base material such as a thin film of YIG (yttrium iron garnet). The ferrimagnetic base material is formed on a supporting plate, for example, a GGG (gadolinium gallium garnet) substrate. On one principal surface of the thin ferrimagnetic base material, a first coupling antenna is formed. Furthermore, on one principal surface of the ferrimagnetic base material, second coupling antennas are formed on both sides of the first coupling antenna. In this magnetostatic wave device, the magnetostatic wave propagated from the first coupling antenna toward both sides of the first coupling antenna is received by the second coupling antennas on both sides of the first coupling antenna.

13 Claims, 3 Drawing Sheets

MAGNETOSTATIC WAVE DEVICE

BACKGROUND OF THE INVENTION

1. Field of the Invention

This invention relates to a magnetostatic wave device and, more particularly, to the same having both an input and output antennas.

2. Description of the Prior Art

FIG. 7 is a perspective view showing one example of the conventional magnetostatic wave devices which constitutes the background of the present invention. The magnetostatic wave device 1 comprises a thin film 2 of YIG (yttrium iron garnet), which the YIG thin film 2 is formed on one principal surface of a GGG (gadolinium gallium garnet) substrate 3. Further, on the YIG thin film 2, one input antenna 4 and one output antenna 5 are provided having a spacing between them. One terminal of the input antenna 4 is grounded and the other is connected to an input terminal (not shown). Further, one terminal of the output antenna 5 is grounded and the other is connected to an output terminal (not shown).

A magnetic field is applied to the magnetostatic wave device 1. Then, in the magnetostatic wave device 1, an input signal entered into the input antenna 4 is excited as a magnetostatic wave, which is propagated on the YIG thin film 2 and received by the output antenna 5.

However, in the magnetostatic wave device 1, the magnetostatic wave is propagated from the input antenna in two directions, that is, the direction shown with arrow B and its opposite one, and only the magnetostatic wave propagated in one direction (direction shown with arrow B) can be received. Therefore, in this magnetostatic wave device 1, a half of total energy is lost in principle.

SUMMARY OF THE INVENTION

Therefore, the principal object of the present invention is to provide a magnetostatic wave device having less insertion loss.

A device of the present invention is a magnetostatic wave device which comprises a ferrimagnetic base material, a first coupling antenna formed on one principal surface of the ferrimagnetic base material and second coupling antennas formed on both sides of the first coupling antenna, on one principal surface of the ferrimagnetic base material.

In this magnetostatic wave device, when a signal is inputted to the first coupling antenna, a magnetostatic wave propagated from the first coupling antenna in both the directions of it is received by the second coupling antennas.

According to the present invention, the magnetostatic wave propagated in both the directions of the first coupling antenna is received, thus this causes less insertion loss.

The above and other object, features, aspects and advantages of the present invention will become clear from the following detailed description taken in conjunction with embodiments thereof with reference to the accompanying drawings.

DESCRIPTION OF THE PREFERRED EMBODIMENT

Figure 1:
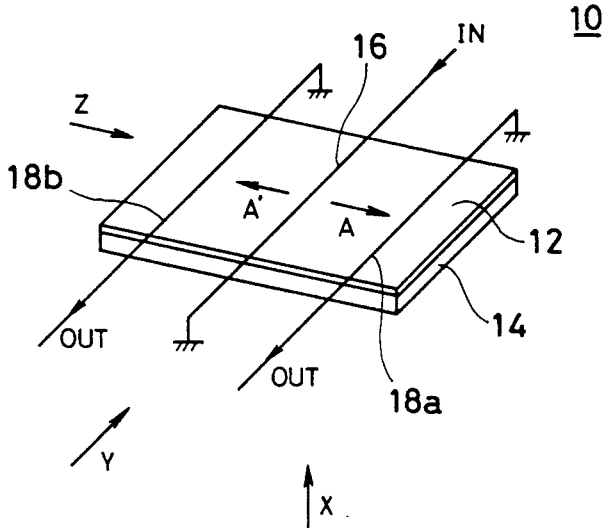
FIG. 1 is a perspective view showing one embodiment of the invention.

FIG. 1 is a perspective view showing one embodiment of the invention. This magnetostatic wave device 10 comprises a YIG (yttrium iron garnet) thin film 12 as a ferrimagnetic base material. The YIG thin film 12 is formed on one principal surface of a GGG (gadolinium gallium garnet) substrate 14 which serves as a supporting plate for supporting the film.

Further, on the YIG thin film 12, a line first coupling antenna 16, for example, is provided along the center portion of a longitudinal size of the thin film. One end of the first coupling antenna 16 is grounded and the other is connected to an input terminal (not shown).

In addition, line second coupling antennas **18*a* and 18*b*, for example, are provided on both sides of the first coupling antenna 16 formed on the YIG thin film 12. These second coupling antennas 18*a* and 18*b*** are grounded at each one end and connected in common to an output terminal (not shown) at each other end.

Figure 7:
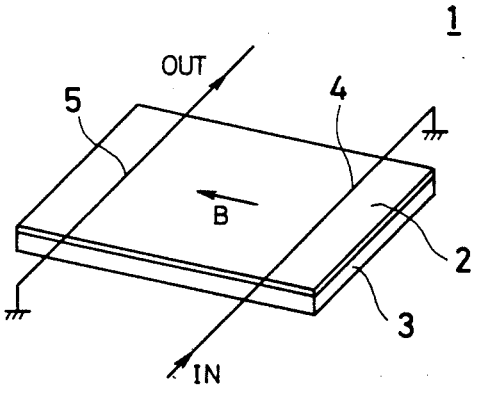
FIG. 7 is a perspective view showing one example of the conventional magnetostatic wave devices.

The magnetostatic wave device 10 is used with application of a d.c. magnetic field in the direction, for example, perpendicular to the principal surface of the YIG thin film 12 (direction shown with arrow X). When a signal is inputted to the input terminal, which the signal is excited as a magnetostatic forward volume wave (MSFVW). Then the magnetostatic forward volume wave is propagated from the first coupling antenna 16 in both the directions of it (directions shown with arrows A and A'). Then the propagated magnetostatic forward volume wave is received by the second coupling antennas **18*a* and 18*b*. Thus, in the magnetostatic wave device 10**, the magnetostatic wave propagating in two directions can be received and this causes less insertion loss as compared with the conventional device of FIG. 7.

Meanwhile, in the magnetostatic wave device 10, a magnetic field may be applied in a direction parallel to the principal surface of the YIG thin film 12 and still perpendicular to the direction of the magnetostatic wave propagation (direction shown with arrow Y). In this case, on the YIG thin film 12, a magnetostatic surface wave (MSSW) is propagated in the directions shown with arrows A and A'. In other case, a magnetic field may be applied in a direction parallel to the principal surface of the YIG thin film 12 and still parallel to the direction of the magnetostatic wave propagation (direction shown with arrow Z). In this case, on the YIG thin film 12, a magnetostatic backward volume wave (MSBVW) is propagated in the directions shown with arrows A and A'. In this way, a direction in which a magnetic field is applied to the magnetostatic wave device 10 may be changed.

Figure 2:
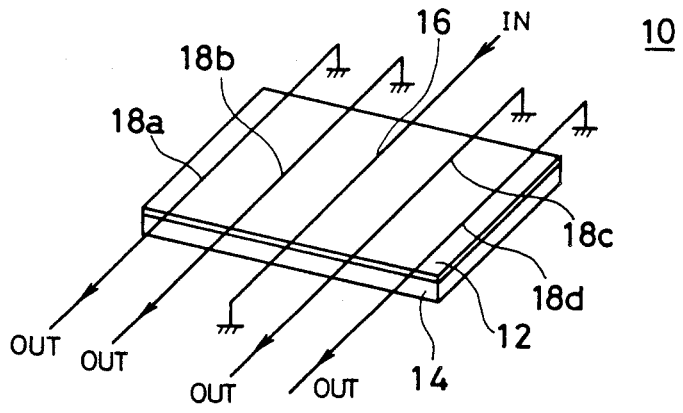
FIG. 2 is a perspective view showing a modification of the embodiment of FIG. 1.

FIG. 2 is a perspective view showing a modification of the embodiment of FIG. 1. In this embodiment, two sets of second coupling antennas **18*a*, 18*b* and 18*c*, 18*d* are provided set by set on each side of the first coupling antenna 16. These second coupling antennas 18*a*, 18*b*, 18*c* and 18*d*** are grounded at each one end and connected in common to an output terminal (not shown) at each other end.

As can be seen from this embodiment, increase in number of the second coupling antennas can improve efficiency of reception of the magnetostatic wave and cause less insertion loss. Number of the second coupling antennas may be further increased.

Figure 3:
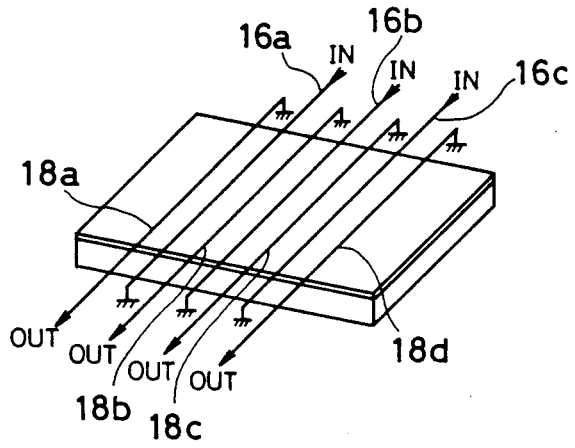
FIG. 3 is a perspective view showing a separate embodiment of the invention.

FIG. 3 is a perspective view showing a separate embodiment of the invention. In this embodiment, three first coupling antennas 16*a*, 16*b* and 16*c* are formed on one principal surface of a YIG thin film 12. These first coupling antennas 16*a*, 16*b* and 16*c* are grounded at each one end and connected in common to an input terminal (not shown) at each other end.

Furthermore, four second coupling antennas 18*a*, 18*b*, 18*c* and 18*d* are formed between the first coupling antennas 16*a*, 16*b* and 16*c* and on their both sides. These second coupling antennas 18*a*, 18*b*, 18*c* and 18*d* are grounded at each one end and connected in common to an output terminal (not shown) at each other end.

As can be seen from this embodiment, increase in numbers of the first coupling antennas and the second coupling antennas can more improve efficiency of reception of the magnetostatic wave and cause less insertion loss. Numbers of the first coupling antennas and the second coupling antennas may be further increased.

Figure 4:
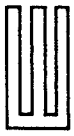
FIG. 4, FIG. 5 and FIG. 6 are plan views showing examples of lines for coupling antennas.
Figure 5:
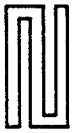
Figure 6:
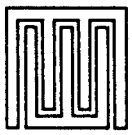

While in the embodiments mentioned above, line antennas are used as the first coupling antenna and the second coupling antenna respectively, lines such as parallel strip lines of FIG. 4 or meander lines of FIG. 5 or interdigital lines of FIG. 6 may be used as the first coupling antenna and the second coupling antenna.

Although, the present invention has been described and illustrated in detail, it is shown only as the illustrations and one example, and it is not to be understood that the invention be limited to those disclosed, and the spirit and true scope of the present invention is limited only by the appended claims.

I claim:

1. A magnetostatic wave device comprising:

a ferrimagnetic base material;

a first coupling antenna comprising an input coupling antenna formed on one principal surface of said ferrimagnetic base material for propagating a magnetostatic wave in opposite directions therefrom;

a second coupling antenna comprising at least first and second output coupling antennas formed on opposite sides of said input coupling antenna, on one principal surface of said ferrimagnetic base material, said output coupling antennas being positioned to receive said magnetostatic wave propagated in opposite directions from the input coupling antenna.

2. A magnetostatic wave device according to claim 1, wherein said ferrimagnetic base material includes a YIG thin film.

3. A magnetostatic wave device according to claim 2, which further includes a supporting plate for supporting said YIG thin film.

4. A magnetostatic wave device according to claim 3, wherein said supporting plate includes a GGG substrate.

5. A magnetostatic wave device according to claim 1, further comprising at least one additional output coupling antenna formed on each side of said input coupling antenna.

6. A magnetostatic wave device according to claim 5, wherein said ferrimagnetic base material includes a YIG thin film.

7. A magnetostatic wave device according to claim 6, which further includes a supporting plate for supporting said YIG thin film.

8. A magnetostatic wave device according to claim 7, wherein said supporting plate includes a GGG substrate.

9. A magnetostatic wave device according to claim 1, wherein at least one additional input coupling antenna is formed on the principal surface of said ferrimagnetic base material, said output coupling antennas being formed between said input coupling antennas and on opposite sides of said input coupling antennas.

10. A magnetostatic wave device according to claim 9, wherein said ferrimagnetic base material includes a YIG thing film.

11. A magnetostatic wave device according to claim 10, which further includes a supporting plate for supporting said YIG thin film.

12. A magnetostatic wave device according to claim 11, wherein said supporting plate includes a GGG substrate.

13. A magnetostatic wave device comprising:

a ferrimagnetic base material;

a first coupling antenna formed on one principal surface of said ferrimagnetic base material, and a signal input means coupled to said first coupling antenna; and a separate second coupling antenna formed on said principal surface of said ferrimagnetic base material, and spaced from each side of said first coupling antenna, and a signal output means coupled to receive signals from said second coupling antennas, said second coupling antennas being positioned to receive waves propagated from opposite sides of said input coupling antenna.

* * * * *